United States Patent [19]

Hanewald et al.

[11] Patent Number: 4,597,564

[45] Date of Patent: Jul. 1, 1986

[54] ROTARY HEARTH

[75] Inventors: Richard H. Hanewald, Beaver Falls; John K. Pargeter, Ellwood City, both of Pa.

[73] Assignee: The International Metals Reclamation Company, Inc., Ellwood City, Pa.

[21] Appl. No.: 737,277

[22] Filed: May 23, 1985

[51] Int. Cl.[4] ..... F27B 9/16

[52] U.S. Cl. ..... 266/274; 266/177; 266/280; 432/138

[58] Field of Search ..... 266/178, 183, 160, 280, 266/274, 177; 432/138; 422/209

[56] References Cited

U.S. PATENT DOCUMENTS

| | | | |
|---|---|---|---|
| 3,452,972 | 7/1969 | Beggs | 266/183 |
| 3,531,095 | 9/1970 | Frans | 266/160 |
| 3,632,698 | 1/1972 | Crespi | 266/280 |
| 3,793,005 | 2/1974 | Kelly et al. | 75/82 |
| 3,922,165 | 11/1974 | Harker et al. | 75/36 |

FOREIGN PATENT DOCUMENTS

| | | | |
|---|---|---|---|
| 881502 | 11/1981 | U.S.S.R. | 432/138 |

*Primary Examiner*—Melvyn J. Andrews

[57] ABSTRACT

A rotary hearth adapted to rotate in horizontal plane having a top surface made of a loose granular refractory material, advantageously dead burned dolomite grain.

5 Claims, 2 Drawing Figures

ROTARY HEARTH

The present invention is concerned with moving hearth furnaces and particularly with rotary hearth furnaces having a hearth made of refractory.

PRIOR ART AND PROBLEM

Various forms of rotary hearth furnaces have been disclosed, for example, in U.S. Pat. Nos. 2,793,109 to Heubler et al, 3,443,931 to Beggs et al, 3793,005 to Kelly et al and 3,922,165 to Harker et al. In each of these furnaces material to be heat processed is placed in a layer directly on the rotating hearth and subjected to radiant heat and the action of combustion gases during travel around the hearth path. If, as in the case of particular concern to the present invention, the material to be processed is a metal oxide along with contaminants and the process involves reduction of such metal oxide, there is a danger that molten product might be produced in the event a temperature excursion takes place in the rotary hearth furnace. If all is ideal, metal oxide is reduced to metal and slag-formers are isolated from the metal at a temperature at which no liquid phases are present. Ideally the process ought to involve only solid and gas phases. But, if the furnace has a hot spot or low melting constituents are inadvertently included in the solid reacting mix, liquifaction of Pelletized or briquetted feed may occur.

The liquifaction or melting of pelletized or briquetted feed on a hearth of a rotary hearth furnace as heretofore constructed can be very damaging. Prior to the present invention, insofar as applicant is aware, rotary hearths have been constructed either by employing a castable refractory on top of a metal support frame or by building up an equally rigid, brick hearth. The hearth of a rotary hearth furnace inherently is exposed to significant, damaging temperature changes. For example, even if one ignores shut-downs and reheats and normally occurring temperature excursions, the inherent operation of the rotary hearth furnace involves removal of very hot product at a point designated designated as 0° or 360° of rotation and placement of cold charge at a point only 5° to 10° of rotation away from the discharge point. Thus with each rotation every part of the hearth is subject to a locus of thermal shock involving a sudden depression in temperature of perhaps 500° in centigrade units. This thermal shocking leads to cracking of rigid hearths. When unintentionally liquified product resting directly on the hearth exists, this product tends to run down cracks and cause deterioration of the hearth. Even solid powder formed from dusting or fracture of briquetted or pelletized product tends to collect in hearth cracks and causes detriment. When an initially flat hearth cracks on its hot face (its upper face) there is a tendency for the hearth to bow which tendency is exacerbated by solid and liquid or quasi-liquid falling into the cracks. Bowing of the hearth can lead eventually to seizure of the hearth necessitating expensive repair or reconstruction. In order to avoid such expensive repair and reconstruction when solid, rigid hearths are used, it is necessary to employ maintenance procedures which counteract the effects of hearth bowing. In any event, be it major repair, reconstruction or practice of maintenance procedures, expensive downtime of the rotary hearth furnace is involved. It is an object of the present invention to alleviate the aforedescribed problems.

GENERAL DESCRIPTION OF THE INVENTION

Figure 1:
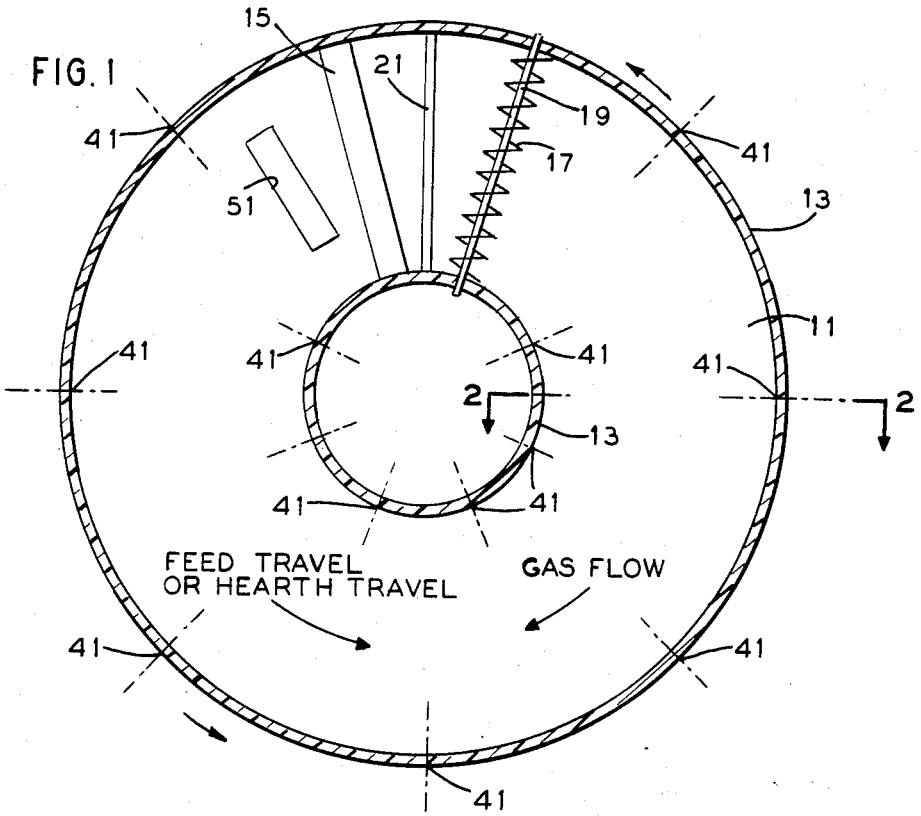
FIG. 1 of the drawing is a plan view of a rotary hearth of the present invention.
Figure 2:
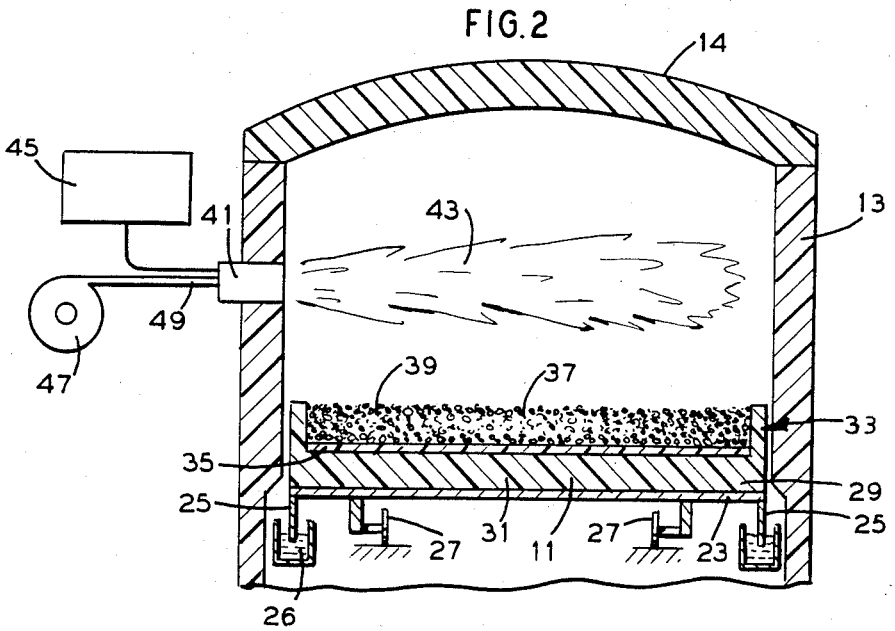
FIG. 2 is a cross-sectional view at section 2-2 of a rotary hearth of the present invention.

The invention contemplates a novel rotary hearth adapted to rotate in a horizontal plane around an axis and employable in a rotary hearth furnace which comprises a top surface exposed to heat made of loose granular refractory material over a supportive insulative base and laterally bounded by inner and outer containing walls. The hearth is further describable as a solid lying between two parallel planes sectioning a toroid, the first of the planes slicing the toroid in half in a direction perpendicular to the axis of formation of the toroid and the other plane being spaced apart from the first plane. The thus developed solid has an inner wall, an outer wall, a top surface and a bottom surface. In the hearth of the invention, the inner and outer walls are of solid refractory and the bottom surface is a metallic (e.g., steel) support bearing a layer of solid refractory. The walls and the bottom together form a bi-truncated toroidal tray which is filled with granular refractory to form the hearth upper or top surface. Advantageously a thin layer of filamentary insulating refractory lies between the solid refractory borne on the metal support and the granular refractory of the top layer.

PARTICULAR DESCRIPTION OF THE INVENTION

The invention is depicted in the drawing. Referring now thereto flat hearth 11 is depicted as rotating counterclockwise within enclosure 13 shown as dashed lines. A cycle begins at point 15 where feed e.g., pellets are placed on hearth 11 by pellet feed mechanism (not depicted) and ends at point 17 where product is taken off by water-cooled screw 19 or other common type feed removal apparatus known to those skilled in the art. Fixed barrier 21, i.e., a hanging refractory wall, partially separates starting point 15 from end point 17. Combustion gases from burners not depicted and gases resulting from processing of feed flow countercurrently to the path of hearth 11 and exit through a vent in the roof of enclosure 13 in the vicinity of point 15. Hearth 11 comprises metal support plate 23 fitted with skirts 25 adapted to travel in continuous water-filled troughs (not depicted) so as to provide gas seals. Metal support plate 23 also has affixed thereto a plurality of sets of wheels 27 adapted to roll on tracks or other equivalent means. As depicted, metal support plate 23 supports refractory trough 29 comprising bottom mass 31 and side walls 33. As shown, trough 29 is monolithic but it may be formed from individual bricks or the like, in any convenient manner. Trough 29 is lined on its bottom with a layer 35 of filamentary refractory such as sold under the tradename "Fibrafax TM" and granular refractory 37 fills trough 29 bounded by side walls 33 and forms hearth top 39.

The purpose of the filamentary refractory between the insulating castable and the granular dolomite grain is as follows. Normally, a large castable hearth bed will crack upon heating and/or cooling due to expansion or contraction. These cracks once formed would tend to fill with fragemented pieces of refractory, fine pieces of feed material or in the case of using granular dolomite, the dolomite itself. If these cracks are allowed to fill with these other aforementioned items, the hearth tends to grow due to its inability to contract to its original diameter upon cooling. Thus upon reheating, the hearth expands to a slightly larger diameter. As can be seen, after several heating and cooling cycles, the hearth could grow to the point where it no longer could freely rotate without touching the outer fixed wall of this furnace. This filamentary refractory prevents any fine feed particles of the granular dolomite from falling into any cracks that might develop in the castable hearth bed.

The hearth in accordance with the invention advantageously comprises a dual layer bottom mass 31. The lower layer is about 7 to about 15 centimeters (cm.) thick made of a low thermal conductivity insulating fire clay brick containing about 40% to 60% $SiO_2$ and 30% to 40% $Al_2O_3$. Above this insulating layer is a layer about 10 to about 20 cm. thick of a light weight, high strength insulating castable generally containing about 55% $Al_2O_3$ and 37% $SiO_2$. Inner and outer rings or side walls 33 are advantageously made of a dense 85% to 90% $Al_2O_3$ burned brick which possesses high hot strength and the ability to withstand abrasion and mechanical wear. Layer 35 of filamentary refractory material can comprise an insulating layer of a light weight, commercial fiber blanket, generally about 2.5 cm. or so thick. Granular refractory layer 37 is advantageously a layer of dead burned dolomite grain about 7.5 to 15 cm. thick. This dead burned dolomite grain generally has the characteristics of 100% minus 1 cm. size, a chemistry of about 54% CaO, 38% MgO and maximum 4% $Fe_2O_3$ and a bulk density of about 3.25 g/cc.

Compared to rotary hearths of the prior art, insofar as applicant is aware, the hearth of the present invention is highly advantageous. In addition to advantages discussed hereinbefore, the hot, upper working surface of the hearth of the present invention can be formed and repaired easily and cheaply. Dead burned dolomite grain or other grain (e.g., magnesite gain, alumina grain, silica grain, fire clay grain etc.) can be installed using unskilled labor by supplying grain through the pellet feeding mechanism at point 15 while hearth 11 is rotating. If repairs are necessary, grain can be removed without cooling the furnace by lowering water cooled screw 19 to the desired level and removing granular refractory 37 in the same manner as product is removed. After sufficient granular refractory 37 is taken off, water-cooled screw 19 is raised to its original level and additional grain is fed into the pellet feeding mechanism at point 15 all while hearth 11 is rotating.

In the hearth of the present invention, it is highly advantageous to use dead burned dolomite grain as granular refractorv 37. Dead burned dolomite is cheap, compared with magnesite. The alternative acidic grain, $Al_2O_3$ fire clay and $SiO_2$ (if carried out with product) can lead to a greater than desired slag expense in subsequent operations where product is melted, e.g., in a basic refractory lined electric furnace. Silica grain, while inexpensive is, in addition, a relatively poor refractory hearth insulator.

The advantage of the hearth of the present invention that it is readily installed and repaired, hot or cold, using equipment present in the rotary hearth furnace is not to be discounted. Installation and repair of traditional refractory brick or solid cast hearths involve high cost skilled labor and considerable furnace down-time. Essentially for repair of these traditional refractory hearths, the furnace must be cooled to allow access by workmen and the repaired hearths must be reheated slowly in order to avoid refractory breakdown. Traditional repair usually requires 6 to 10 days of down-time whereas the hot replacement of dead burned dolomite can be accomplished in as little as 8 hours or less using cheaper non-skilled labor and a cheap, readily available refractory material.

While the present invention has been described and illustrated in accordance with specific embodiments those skilled in the art will appreciate that modifications and variations can be made. Such modifications and variations are intended to be within the ambit of the claims.

We claim:

1. A rotary hearth employable in a rotary hearth furnace comprising a supportive, insulative impervious base supporting inner and outer containing walls, said hearth being adaptable to rotate in an essentially horizontal plane around an axis, said base having a top surface exposed to heat which top surface comprises loose granular refractory material bounded by said inner and outer containing walls.

2. A rotary hearth as in claim 1 wherein the loose granular refractory material is dead burned dolomite grain.

3. A rotary hearth as in claim 1 wherein said inner and outer containing walls are comprised of a dense alumina brick.

4. A rotary hearth as in claim 2 to which the dead burned dolomite has grain size of 100% minus 1 cm.

5. A rotary hearth as in claim 1 in which said supportive, insulative impervious base is carried on a lowermost metal support and comprises a lower layer of insulative fire clay brick adjacent said metal support, and a layer of alumina-silica high strength insulating castable refractory stop said insulating fire clay brick, in which inner and outer containing walls comprises dense 85% to 90% alumina burned brick and in which a fiberous insulating blanket separates said layer of alumina-silica high strength insulating castable refractory and said top surface of loose granular refractory material.

* * * * *